US005160557A

United States Patent [19]

Chang

[11] Patent Number: 5,160,557

[45] Date of Patent: Nov. 3, 1992

[54] METHOD FOR IMPROVING LOW TEMPERATURE DUCTILITY OF DIRECTIONALLY SOLIDIFIED IRON-ALUMINIDES

[75] Inventor: Keh-Minn Chang, Schenectady, N.Y.

[73] Assignee: General Electric Company, Schenectady, N.Y.

[21] Appl. No.: 736,147

[22] Filed: Jul. 26, 1991

[51] Int. Cl.[5] ..... C21D 8/00

[52] U.S. Cl. ..... 148/546; 148/621; 148/404

[58] Field of Search ..... 148/2, 11.5 Q, 12 R, 148/404, 11.5 A, 437, 320, 621, 546

[56] References Cited

U.S. PATENT DOCUMENTS

| | | | |
|---|---|---|---|
| 4,021,271 | 5/1977 | Roberts | 148/2 |
| 4,613,480 | 9/1986 | Chang et al. | 148/429 |
| 4,961,903 | 10/1990 | McKamey et al. | 420/77 |
| 4,988,488 | 1/1991 | Kang | 420/460 |
| 5,084,109 | 1/1992 | Sikka | 148/621 |

*Primary Examiner*—R. Dean
*Assistant Examiner*—Sikyin Ip
*Attorney, Agent, or Firm*—Paul E. Rochford; James Magee, Jr.

[57] ABSTRACT

A method of improving the low temperature ductility of an iron-aluminide is taught. The aluminide for which the method is applicable is one having between 30 and 50 atom percent of aluminum. The aluminide may also have substituents for part of the iron and for the aluminum. The alloy may contain up to 10 atom percent of substituents for the iron selected from the group of metals comprising nickel cobalt chromium and manganese. The alloy may also contain substituents for the aluminum of up to 5 atom percent of a metal selected from the group comprising titanium, niobium, tantalum, hafnium, zirconium, vanadium, and silicon. The alloy has a B2 crystal structure. The first step of the process is to select the metal to be processed. The next step is to directionally solidify the selected metal. The next step is to determine the Ductile Brittle Transition Temperature (DBTT). The metal is then heated to above the DBTT and is deformed while above the DBTT temperature. As a result of this treatment the ductility of the alloy is greatly improved.

9 Claims, 1 Drawing Sheet

DIRECTIONALLY SOLIDIFIED Fe-40A1

METHOD FOR IMPROVING LOW TEMPERATURE DUCTILITY OF DIRECTIONALLY SOLIDIFIED IRON-ALUMINIDES

BACKGROUND OF THE INVENTION

The present invention relates generally to improving the properties of intermetallic compositions. More particularly, it relates to improving the ductility of iron-aluminides.

It is well-known that aluminide intermetallics have received much attention recently in research programs because of their potential as high temperature materials for structural applications. In general, aluminides of various metals are found to have relatively low density because of the presence of the aluminum. They also have good temperature stability at elevated temperatures and in addition relatively poor ductility at lower temperatures. Iron-aluminide, FeAl, is one of the group of aluminide intermetallics. Iron-aluminide is one of the high temperature aluminides which do not fail elastically at room temperature under tension loading. However, fracture of these aluminides does occur intergranularly in conventional equiaxed high aluminide alloys.

I have found that directional solidification of iron-aluminide can generate an elongated grain structure. Since the area of grain boundaries traverse to a stress direction is minimized for directionally solidified iron-aluminides, a directionally solidified structure is deemed to be resistant to intergranular failure such as those noted above to occur in conventional equiaxed high aluminide alloys. Ideally, single crystal intermetallics can completely eliminate the grain boundary and can consequently eliminate the grain boundary brittleness problem. Accordingly, high temperature properties can be significantly improved by the employment of directionally solidified or single crystal iron-aluminide materials. Similar phenomena have been demonstrated in the case of cast superalloys.

Directional solidification changes the mode of failure for iron-aluminides from an intergranular mode to a transgranular mode at low temperatures Ductile Brittle Transition Temperature (DBTT) for such directionally solidified compositions decreases to about 300° C. The tensile elongation for such directionally solidified iron-aluminide compositions at room temperature has an upper limit of about 2-3%.

What is sought pursuant to the present invention is improvement in the lower temperature tensile elongation of directionally solidified iron-aluminides.

BRIEF DESCRIPTION OF THE INVENTION

Accordingly, it is one object of the present invention to substantially increase the room temperature tensile elongation of iron-aluminides.

Another object is to provide a simple method by which the lower temperature tensile elongation of directionally solidified iron-aluminides can be significantly increased.

Another object is to provide iron-aluminides having elevated tensile elongation at room temperature.

Other objects and advantages of the present invention will be in part apparent and in part pointed out in the description which follows In one of its broader aspects, objects of the present invention can be achieved by improving the low temperature ductility of iron-aluminides by a method which comprises providing an alloy selected from the group consisting of iron-aluminides having 30 to 50 atom percent aluminum, said alloy having a substituent for the iron of said alloy of up to 10 atom percent of a metal selected from the group consisting of nickel, cobalt, chromium, and manganese, said alloy having a substituent for the aluminum of said alloy of up to 5 atom percent of a metal selected from the group consisting of titanium, niobium, tantalum, hafnium, zirconium, vanadium, and silicon, directionally solidifying said alloy, said alloy having a B2 crystal structure, heating said alloy to above its DBTT, and deforming said selected alloy at a temperature above its DBTT.

BRIEF DESCRIPTION OF THE DRAWING

The detailed description of the invention which follows will be understood with greater clarity if reference is made to the accompanying drawing in which.

DETAILED DESCRIPTION OF THE INVENTION

Figure 1:
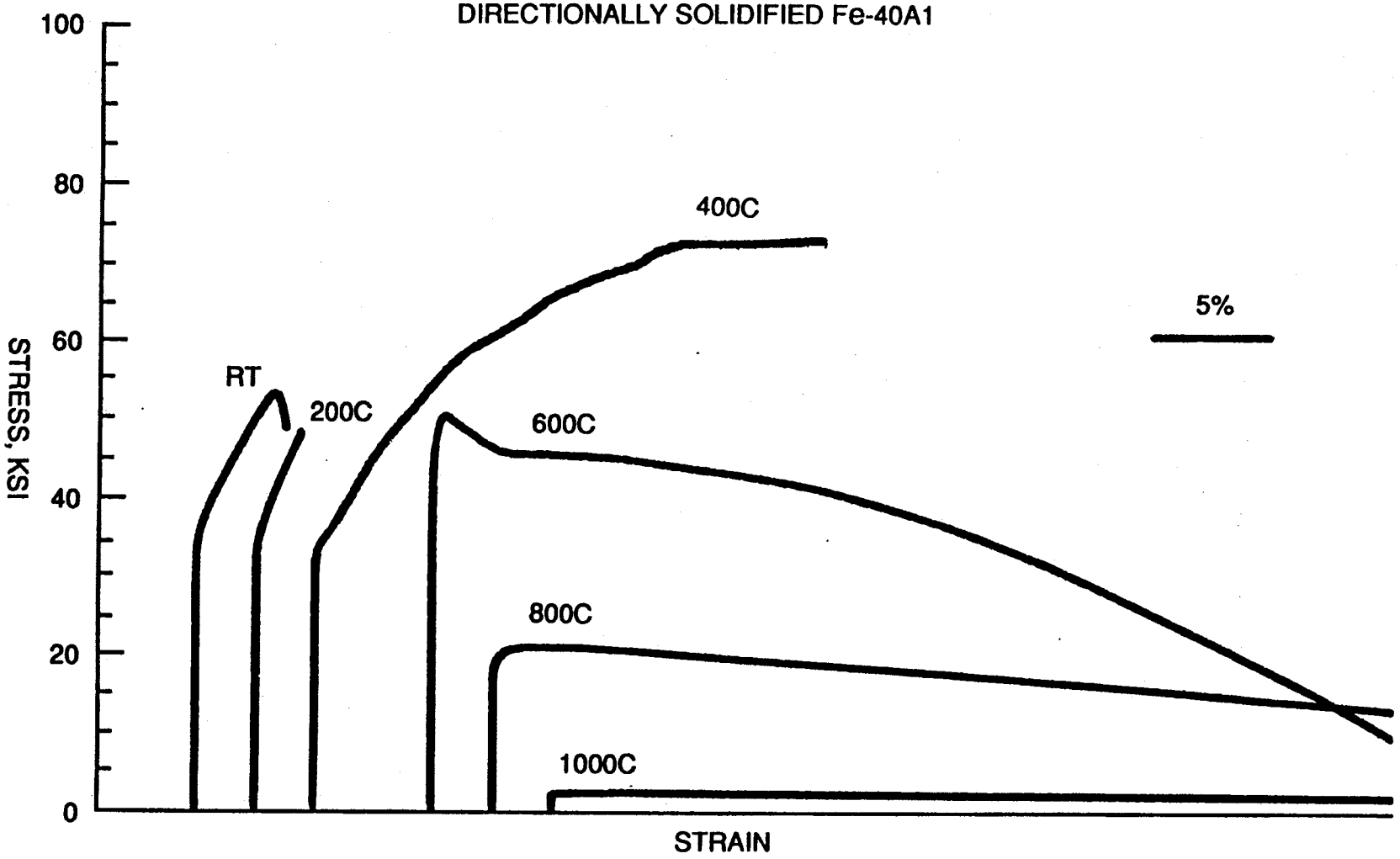
FIG. 1 is a graph in which stress in ksi is plotted against strain for a directionally solidified sample of iron-aluminide containing 40 atom percent of aluminum.

The inventive concept and the manner in which it is carried into effect is now described with reference to the treatment of a number of samples.

Several heats of FeAl-base intermetallic compositions were prepared by vacuum induction melting. The samples contained 40 atom percent of aluminum in the iron base composition.

Directional solidification was carried out on these samples using the conventional Bridgman technique at a furnace temperature of 1600° C. with a drawing rate of 0.042 millimeters per second. A metallographic examination of the product of the directional solidification evidenced that elongated grains grew continuously along the length of the directionally solidified casting.

Tensile tests were carried out and the results of these tests relative to the effects of strain and stress on directionally solidified iron-aluminide intermetallic is plotted in FIG. 1

As noted above, FIG. 1 is a graph of the results of a study of applied stress in ksi to a resultant strain illustrated along the abscissa with a legend indicating the length of a 5% strain. As indicated on the individual plots, the temperature of the individual studies were made at values from room temperature to 1000° C. The ductile to brittle transition temperature occurs clearly at 300° C. Scanning electron microscopic study of the fractured samples of this study shows the fracture mode to be transgranular cleavage along the [100] crystalline planes at low temperatures.

X-ray diffraction studies of the alloy also established that the crystal structure of the alloy was B2.

The present invention is associated with the improvement of ductility below the ductile to brittle transition temperature. The method of the present invention consists of applying a small amount of prestrain at temperatures above the ductile to brittle transition temperature. A demonstration of the effect of this application of prestrain was carried out on directionally solidified Fe-40Al metal samples and the results are summarized in Table I.

TABLE I

| Tensile Testing at Room Temperature | | |
|---|---|---|
| Prestrain Temp. C. | Prestrain Deformation % | Room Temp. Elong. % |
| | | 1.6 (untreated alloy) |
| 400 | 0.9 | 9.8 |
| 800 | 1.2 | 6.1 |
| 400 | 2.4 | 12.6 |
| 600 | 2.5 | 10.9 |
| 800 | 2.7 | 13.1 |

As is evident from the data included in Table I, the application of a low level of prestrain to the samples of the directionally solidified Fe-40Al results in a large increase in room temperature elongation to values above 10%.

A special tensile test which is identified here as a "small-scale yielding test" was devised to further confirm the improvement in ductility represented by the figures listed in FIG. 1. According to this test, starting from about 700° C., one directionally solidified specimen was loaded with stress until yielding occurred and the yielding was permitted to continue until a plastic strain of about 2% had been achieved after which the stress loading was relieved. The specimen was then cooled down by 100° C. and the small-scale yielding test was repeated. The process of repeating the small-scale yielding test was continuously repeated down to a testing temperature of 100° C and at this temperature the specimen was strained to failure.

This type of small scale yielding (S.S.Y.) test was performed on many iron-aluminide base intermetallic alloys having a variety of aluminum concentrations. Each of these alloys having the different compositions was processed through directional solidification. The results of prestrain and as-directionally solidified specimens are compared in Table II.

TABLE II

| Tensile Testing at 100° C. Final Testing Temperature | | |
|---|---|---|
| Composition | As-Directionally Solidified | After S.S.Y. Test |
| Fe—36Al | 5.6 | 24.3 |
| Fe—40Al | 1.9* | 8.7 |
| Fe—44Al | 4.3 | 9.3 |
| Fe—48Al | 0.2 | 25.1 |

*measured at 200° C.

As is evident from the data plotted in Table II above, the low temperature elongation of these directionally solidified iron-aluminide base intermetallic samples is remarkably improved over a wide stoichiometric ratio of iron and aluminum in the aluminide.

What I have found is that I can very substantially increase the ductility of an iron-aluminide alloy by following the steps as set forth above. In this way, I have succeeded in increasing the ductility of iron-aluminide alloys by values in the range of 500 or 600%. It will be realized that for alloys having relatively low initial ductility, that the achievement of an increase of 500 or 600% in ductility is a very valuable and significant achievement.

Further, I have determined that the alloys to which the subject process is applicable are alloys which have the B2 crystal form. I have further determined that iron-aluminides which have a number of other metals substituted for the iron will benefit from the present invention just as well as the binary iron-aluminide alloy itself. Further, I have determined that certain other metals may be substituted for a portion of the aluminum of the iron-aluminide and the benefits of the invention may still be achieved.

With regard first to the iron, a substitution of up to 10% of the iron may be carried out without departing from the scope of the present invention. Thus, up to 10% of any one or more of the metal selected from the group consisting of nickel, cobalt, chromium, and manganese may be substituted for the iron of the iron-aluminide and the invention as described above will operate fully satisfactory.

With regard next to the aluminum, I have determined that up to 5% of one or more of the metals selected from the group consisting of titanium, niobium, tantalum, hafnium, zirconium, vanadium, and silicon can be substituted in the iron-aluminide alloy for the aluminum constituent without losing the benefits and advantages of the present invention.

The present method is particularly valuable for improving the ductility of iron-aluminides for operating at lower temperatures. By lower temperatures as used herein is meant that at temperatures below the ductile brittle transition temperature.

The method gives valuable results for iron-aluminides of stoichiometric ratios and also of the alloys which have between 35 and 45 atom percent aluminum. It is important that the alloy having substituents retain the B2 crystal structure.

Further, the method applies to the processing of the alloy in which the step of directional solidification is part of the processing.

What is claimed is:

1. A method of improving the low temperature ductility of iron-aluminides which comprises providing an alloy a consisting essentially of iron-aluminides having 30 to 50 atom percent aluminum, said alloy having a substituent for the iron of up to 10 atom percent of a metal selected from the group consisting of nickel, cobalt, chromium, and manganese, said alloy having a substituent for the aluminum of said alloy of up to 5 atom percent of a metal selected from the group consisting of titanium, niobium, tantalum, hafnium, zirconium, vanadium, and silicon, directionally solidifying said alloy, said alloy having a B2 crystal structure, heating said alloy to above its Ductile Brittle Transition Temperature, and deforming said selected alloy at a temperature above its Ductile Brittle Transition Temperature, thereby to substantially improve the ductility of the alloy at temperatures below the Ductile Brittle Transition Temperature.

2. The method of improving the low temperature ductility of iron-aluminides which comprises providing an alloy consisting essentially of iron-aluminides having 30 to 50 atom percent aluminum, said alloy having a substituent for the iron of up to 10 atom percent of metal selected form the group consisting of nickel, cobalt, chromium, and manganese, said alloy having a substituent for the aluminum of said alloy of up to 5 atom percent of a metal selected from the group consisting of titanium, niobium, tantalum, hafnium, zirconium, vanadium, and silicon, directionally solidifying said alloy, said alloy having a B2 crystal structure, determining the ductile brittle transition temperature of said alloy, heating said alloy to above its ductile brittle transition temperature, and deforming said selected alloy at a temperature above its ductile brittle transition temperature, thereby to substantially improve the ductility of the alloy at temperatures below the ductile brittle transition temperature.

3. The method of claim 1, in which the selected alloy has between 35 and 45 atom percent aluminum.

4. The method of claim 1, in which the iron-aluminide has about 40 atom percent aluminum.

5. The method of claim 1, in which the deformation of said alloy is by hot working.

6. The method of claim 1, in which the alloy has a substituent for iron of at least 5 atom percent.

7. The method of claim 1, in which the alloy has a substituent for iron of up to 5 atom percent.

8. The method of claim 1, in which the alloy has a substituent for aluminum of less than 4 atom percent.

9. The method of claim 1, in which the alloy has a substituent for aluminum of up to 2 atom percent.

* * * * *